US006491051B2

(12) United States Patent
Pierce et al.

(10) Patent No.: US 6,491,051 B2
(45) Date of Patent: Dec. 10, 2002

(54) SOLAR SURVIVAL SHELTER

(76) Inventors: Richard Carter Pierce, 2875 Washington St., Roxbury, MA (US) 02119; Wanda Lynne Pierce, 2442 S. Oxford St., Arlington, VA (US) 22206

( * ) Notice: Subject to any disclaimer, the term of this patent is extended or adjusted under 35 U.S.C. 154(b) by 13 days.

(21) Appl. No.: 09/749,883

(22) Filed: Dec. 29, 2000

(65) Prior Publication Data

US 2002/0083968 A1 Jul. 4, 2002

(51) Int. Cl.[7] ..... A45F 1/16

(52) U.S. Cl. ..... 135/87; 135/92; 135/97; 135/120.3; 135/127; 135/137; 135/156

(58) Field of Search ..... 135/87, 92, 97, 135/127, 137, 156, 120.3

(56) References Cited

U.S. PATENT DOCUMENTS 4,320,744 A * 3/1982 Fodor ..... 135/87
4,719,935 A * 1/1988 Gustafson ..... 135/95
4,809,726 A * 3/1989 Gilllis ..... 135/109
5,216,834 A * 6/1993 Crowley ..... 47/17
5,244,508 A * 9/1993 Colozza ..... 136/245
5,582,197 A * 12/1996 Dobberstein ..... 135/87
5,669,584 A * 9/1997 Hickey ..... 244/158 A
5,755,987 A * 5/1998 Goldstein ..... 252/70
5,755,988 A * 5/1998 Lane ..... 252/70

* cited by examiner

*Primary Examiner*—Beth A. Stephan

(57) ABSTRACT

A tent comprising: a) a fabric covering including a plurality of longitudinal walls and end walls, wherein a first longitudinal wall has an opening having around its periphery a panel attachment means and wherein said longitudinal walls are sewn to said end walls; b) a support means positioned in proximity to each of said end walls sufficient to cause said longitudinal walls to form a triangle when affixed to a support means; and c) a panel containing a phase change material sufficient to heat said tent's interior when cold and cool said interior when hot.

8 Claims, 2 Drawing Sheets

SOLAR SURVIVAL SHELTER

BACKGROUND OF THE INVENTION

The present invention relates to portable shelters. More particularly, it relates to a self-contained tent configured to selectively utilize solar energy in combination with a phase change material in order to absorb sunlight and radiate energy to maintain said tent at a constant temperature in sunlight and darkness.

With the increasing popularity of outdoor activities, a resurgence of interest occurred in the camping industry. A variety of tent designs evolved to meet his demand. Such Tents have been designed to meet a variety of user needs and seasonal conditions relative to various user groups which range from the occasional camper, to backpackers, to mountain climbers, to name a few.

Most current tent designs provide single layer, nylon fabric walls and multi-section support frames. Support frames may thread through sleeves at the walls or fit to external fasteners. Some tents include captured frames which store with the tent.

Depending upon the user group, tents typically assemble to a walled cabin configuration or to a variety of geodesic shapes. For serious campers, shapes and numbers of pole supports are configured to provide a low profile structure which is stable under windy conditions. For occasional users, fewer sections are typically provided, and the height of the tent is increased to permit standing. None of the tents are constructed to primarily accommodate solar conditions.

Triangular and A-frame tents are also known. Many traditional tents, such as used by boy and girl scouts, erect to isosceles triangle configurations. Low profile tents are principally used for sleeping accommodations. An access opening at an end wall permits entry and a covering rain fly may be separately supported above the tent.

U.S. Pat. No. 5,582,197 issued to Dobberstein on Dec. 10, 1996 discloses a solar tent. This patent discloses a fabric tent wherein multi-layered fabric walls are constructed and arranged to be reversible so as to selectively reflect or absorb solar radiation in cooperation with a longitudinal access door. Said door has a removable cover, screen and/or window panels including adjustable relief panels which vary the exposure. This patent is hereby incorporated by reference herein.

Gustafson in U.S. Pat. No. 4,719,935 which issued on Jan. 19, 1988, teaches a multi functional tent. Gustafson discloses a solar heated tent in which the interior is protected from the effects of inclement weather and insects.

U.S. Pat. No. 5,669,584 issued to the United States of America, Navy on Sep. 23, 1997 discloses an apparatus for holding a space vehicle at a constant temperature. This apparatus has a cellular sandwich on the outer surface of the space vehicle. This sandwich has two outer layers and translucent cells between the two outer layers. The translucent cells contain a phase change material. The outer layer is more distant from the space vehicle. In this position, the outer layer is able to transmit sunlight to the translucent cells and transmit radiation away from the translucent cells. The phase change material absorbs sunlight and radiating energy so as to maintain the space vehicle a constant temperature in sunlight and darkness. This patent is hereby incorporated by reference herein.

Therefore, what is needed is a portable shelter or tent that is able to maintain a constant temperature in sunlight and darkness via a phase change material.

SUMMARY OF THE INVENTION

This invention is directed to a tent having a fabric covering. The covering includes a plurality of longitudinal walls and end walls. The first longitudinal wall has an opening that has around it an attachment means for securing within said opening a panel containing a means for heating and cooling the tent's interior. The longitudinal walls are attached to end the end walls. Sewing is the preferred means for attaching said longitudinal walls to the end walls. A support means is positioned in close proximity to each of said end walls in a manner sufficient to cause said longitudinal walls to form a triangle of a height sufficient to permit entry into said tent.

Prior to erecting the tent, said panel is securely affixed to the longitudinal wall having an opening therein. When the tent is erected and the end walls closed, a phase change material ("PCM") contained within said panel causes the tent's interior to be heated or cooled thereby keeping occupants within said tent comfortable. The phase change material is activated by solar energy. When solar energy is absorbed by the PCM, the tent's interior is cooled. At night, energy absorbed the PCM is released whereupon the tent's interior is heated. In order to maximize solar energy absorption, the panel containing said PCM is positioned so as to face the sun.

It is therefore an object of this invention to provide for a means for safely heating a tent without utilization of an open flame.

Another object of this invention is to provide for a means for keeping occupants of a tent warm and thereby minimize the use of bulky sleeping bags and blankets.

Yet another object of this invention is maximize available space in a tent by avoiding the use of sleeping bags and blankets.

Still another object of this invention is to provide vents at end walls to control interior conditions in the tent.

Yet another further object of this invention is to provide for fastening means to securely affix a panel containing a PCM within a longitudinal tent wall.

And still yet further object of this invention is provide a hook and loop fastener means to affix a panel containing a PCM within a longitudinal tent wall.

An even still yet further object of this invention is to utilize solar energy to heat a tent's interior even in cold weather so long as the sun is shining.

DESCRIPTION OF THE PREFERRED EMBODIMENT

Figure 1:
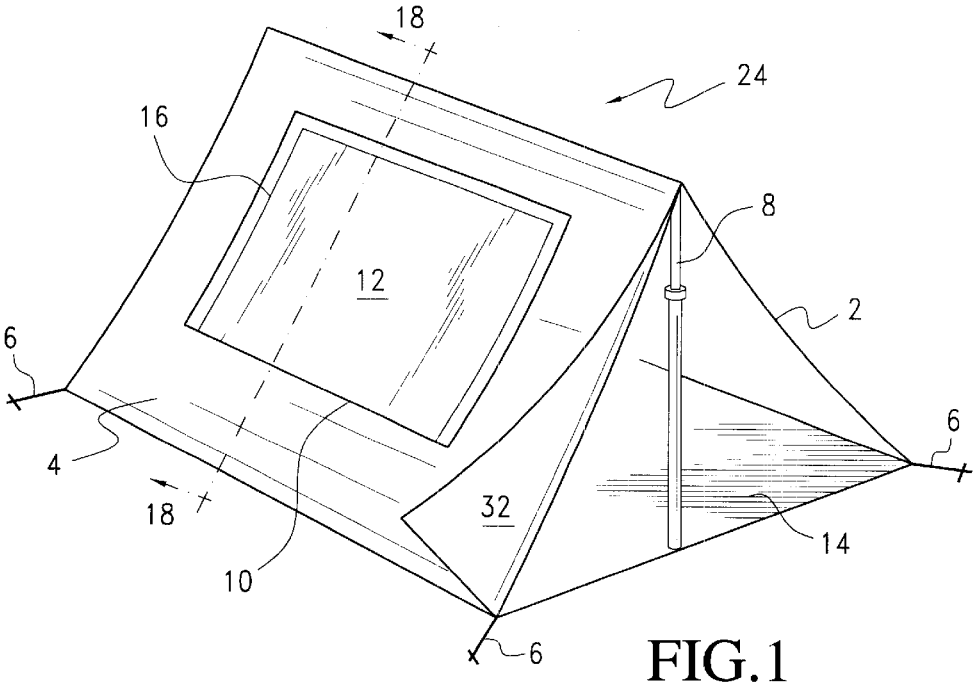
FIG. 1 is a perspective view of a tent containing longitudinal walls where one longitudinal wall has affixed therein a panel contains a PCM.
Figure 4:
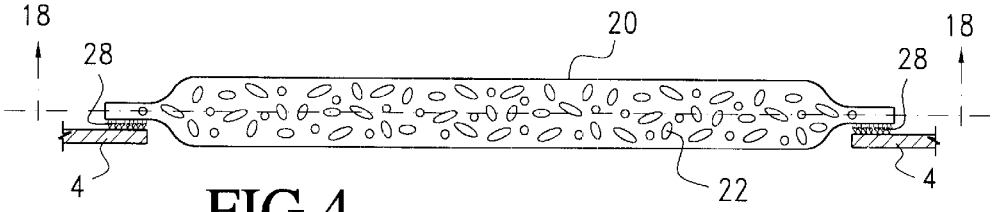
FIG. 4 is a sectional view of a hook and loop fastening means for securing a panel containing PCM in a longitudinal wall opening.

In the practice of this invention, referring to FIG. 1, tent 24 is shown with two longitudinal walls 2 and 4. Longitudinal wall 2 lacks an opening. Longitudinal wall 4 contains an opening 10 with attachment means 28 encompassing the edge of opening 10. Cover means 16 is connected as a flap above and on each side of opening 10 in a manner sufficient to prevent water from entering longitudinal wall 4. Prior to erecting tent 24, panel 12 containing the phase change material is placed over opening 10. As is preferred, panel 12 is secured onto longitudinal wall 4 via a hook and loop attachment means 28 which encompasses the outer edge of panel 12. When contact is made with hook and loop attachment means 28 that encompasses opening 10 and hook and loop attachment means encompassing outer edge of panel 12, PCM panel 12 is then securely attached to longitudinal wall 4. Hook and loop attachment means 28 is shown in FIG. 4. Also shown in cross sectional view FIG. 4 is phase change material 22.

Figure 2:
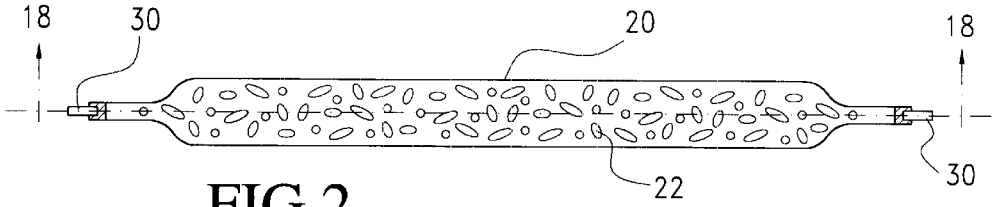
FIG. 2 is a sectional view of a zipper fastening means for securing a panel containing PCM in a longitudinal wall opening with PCM panel along line 18 from FIG. 1.

In another embodiment, referring to FIG. 2, a zipper attachment means 30 is depicted. Alternatively, PCM panel 12 can be secured to longitudinal wall 4 via a zipper attachment means. To accomplish this, one side of zipper attachment means 30 is affixed along the outer edge of opening 10. The other side of zipper means 30 is attached along the outer edge of PCM panel 12. When panel 10 is placed within opening 10, it is secured therein when zipper means 30 is fully engaged.

Once PCM panel 12 is secured in longitudinal wall 4, it along with longitudinal wall 2 and end walls 32 is raised. These walls are held up when adjustable pole means 8 is positioned under longitudinal walls 2 and 4 in proximity to end walls 32. To stabilize the tent, ropes 6 or other support means are employed. Once erected, floor 14 can be placed inside the tent if desired.

As will be understood by those skilled the art, at least one PCM panel 12 can be used on other tent designs so long as the surface area of at least one longitudinal wall 4 are large enough to contain said panel. For example, as is shown in FIG. 5, PCM panel 12 can be utilized in a room tent.

The phase change material can be employed in a foldable polyhedral tent as disclosed by Gillis in U.S. Pat. No. 4,809,726 that issued on Mar. 7, 1989. This patent is incorporated by reference herein. The phase change material can be in a panel as taught above or manufactured into the tent's fabric as described below.

Figure 6:
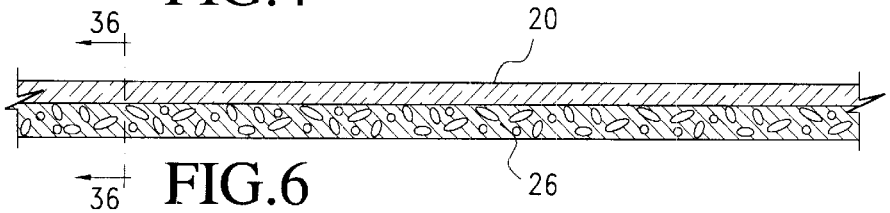
FIG. 6 is a cross-sectional view represented by line 36 which illustrates the relationship between the translucent plastic layer and second underlying layer containing PCM.
Figure 3:
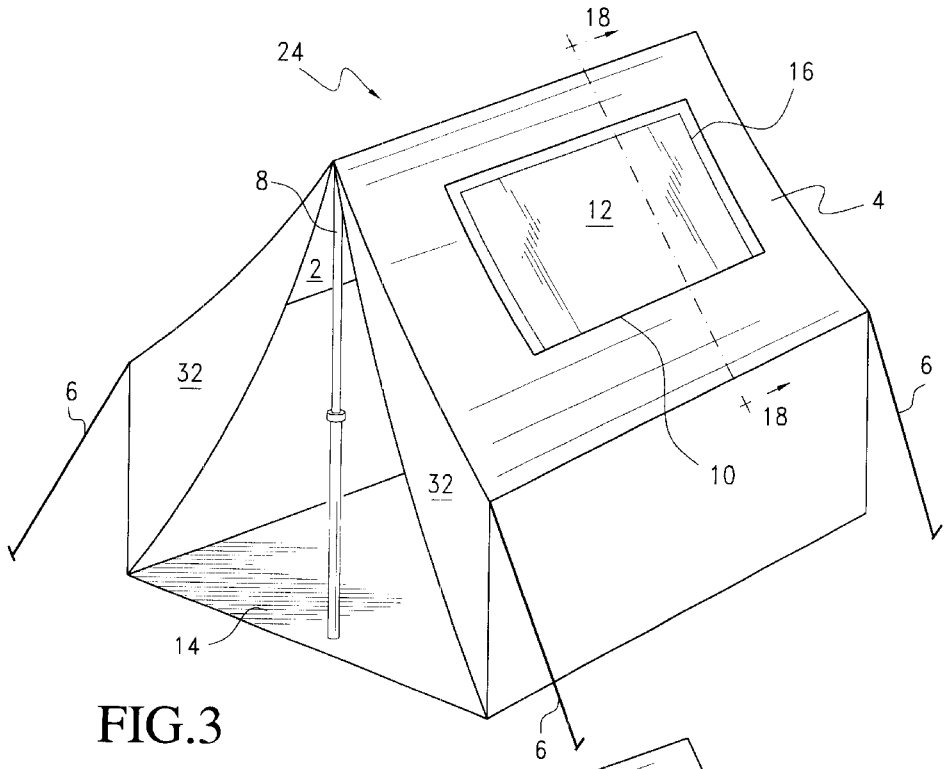
FIG. 3 is a perspective view of a room tent containing a PCM panel within a longitudinal wall.
Figure 5:
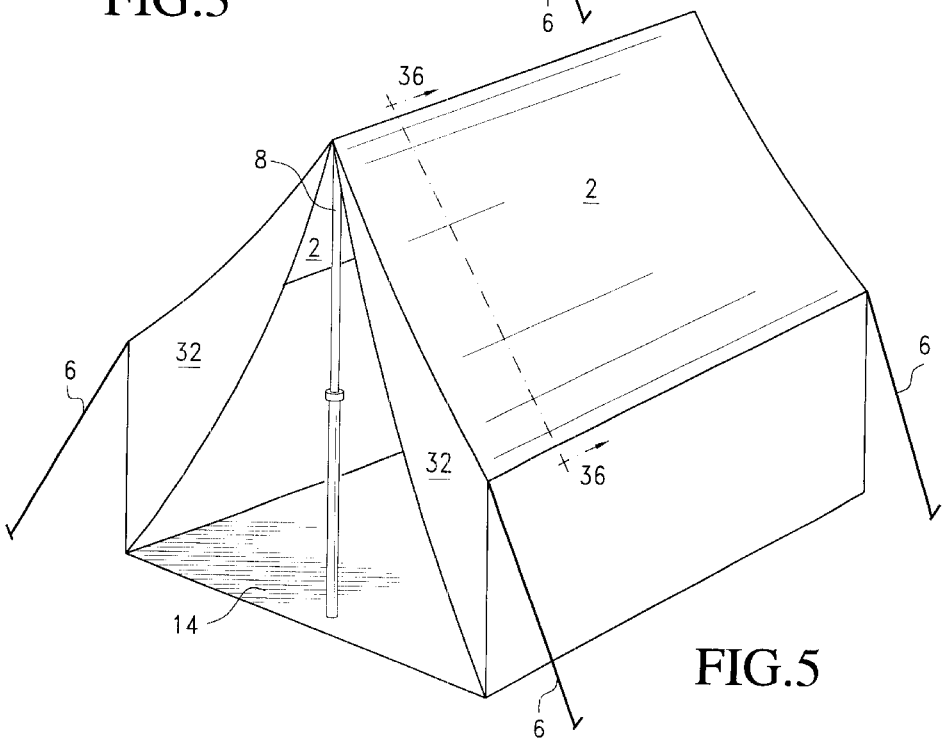
FIG. 5 depicts a room tent, which has the PCM incorporated into a second layer underlying a translucent plastic material.

In another embodiment of this invention, as is depicted in FIG. 5, a phase change material can be Permanently incorporated into longitudinal wall 2. In this embodiment, a layer of translucent plastic material 20 is placed over a second layer of fabric 26 containing a phase change material. The amount of phase change material contained in the fabric is sufficient to obtain a desired internal temperature in the tent. As will be readily apparent to one skilled in the art, the amount of phase change material will vary depending on several variables. These variables include the following: the size of the tent; fabric utilized in the manufacture of the tent; environmental condition to be encountered; and the number of occupants expected to be sheltered in the tent. As is shown in FIG. 6, line 36 represents a cross-sectional view of first translucent plastic layer 20 and second layer 26 containing the PCM. As is preferred, sodium acetate is the desired PCM to be incorporated into second layer 26.

FIGS. 2 and 4 are cross-sectional views of PCMs in panel 12 graphically detailing how the phase change materials are contained in said panel.

Another PCM which can be used in the practice of this invention is disclosed in U.S. Pat. No. 5,755,988 assigned to Dow Chemical Co. This patent issued on May 26, 1998 and is hereby incorporated by reference here in. This patent discloses dibasic acid based phase change compositions. The phase change material comprises a high molecular weight dibasic organic acid and mixtures thereof. Miscible aliphatic and aryl monobasic acids are also suitable as PCM constituents. This PCM is capable of absorbing thermal energy from air and radiation sources. In the course of absorbing thermal energy the PCM undergoes a reversible melt. When the PCM is exposed to a temperature below its melting temperature it releases stored latent heat of fusion energy absorbed upon melting and undergoes a reversible freeze.

U.S. Pat. No. 5,755,987 assigned to Dow Chemical Co. disclosed dibasic ester based phase change material compositions. This patent issued on May 5, 1998 and is hereby incorporated by reference herein. A family of organic compounds having chemical properties that make them suitable for use as phase change materials is described. These compositions comprise esters of dibasic acids. These materials have high latent heats of fusion, low flammability, low miscibility with water, low cost, availability and a range of melting temperatures. These PCMs may be enclosed in a single, non-compartmentalized container with immiscible phase change material substances to moderate the melting temperatures of the PQMs.

Another phase change material that can be used herein is disclosed in U.S. Pat. No. 5,669,584 which issued on Sep. 23, 1997. This patent is incorporated by reference herein. Disclosed is a space vehicle apparatus including a cellular sandwich with phase change material. This apparatus is used to hold a space vehicle at a constant temperature. The cellular sandwich has two outer layers and translucent cells between the two outer layers. The translucent cells contain a PCM. The outer layer is more distant from the space vehicle so as to transmit sunlight to the translucent cells and also transmit radiation away from the translucent cells. The phase change material absorbs sunlight and radiates energy to maintain the space vehicle at a constant temperature in sunlight and darkness.

In the preferred practice of this invention, a selected phase change material is placed into panel 12. After the tent with longitudinal wall 4 has panel 12 secured therein, tent 24 as shown in FIG. 1 is erected and positioned to receive maximum amount of sunlight. When solar energy contacts translucent plastic material 20, it heats up and transfers thermal energy to PCM contained in panel 12. Thermal energy absorbed by the PCM causes the PCM to change its state. The PCM continues to absorb and store thermal energy from solar energy while the sun shines. Absorption of solar energy via panel 12 results in a lower temperature in the tent's interior. When the sun goes down, thermal energy stored in panel 12 is released into the tent's interior thereby keeping occupants of the tent warm. Thermal energy continues to be released from PCMs in panel 12 until the PCMs cool enough to revert back to its original state. Once the PCM has reverted back to its original state, additional solar energy can be absorbed by it when the sun comes up. In this manner, the process of cooling and heating the tent's interior can be repeated over and over again.

Although the present invention is described with preferred embodiments, it is to be understood that modifications and variations may be resorted to without departing from the spirit and scope of this invention as those skilled in the art will readily understand. Such modifications and variations are considered to be within the purview and scope of the appended claims.

What is claimed is:

1. A tent comprising:

a) a fabric covering including a plurality of longitudinal walls an d end walls, wherein a first longitudinal wall has an opening therein into which opening a panel attachment means is located and wherein said longitudinal walls are attached to said end walls;

b) a support means positioned under each of said end walls sufficient to cause said longitudinal walls to form a triangle when affixed to the support means; and c) a panel containing a phase change material sufficient to heat said tent's interior when cold and cool said interior when hot.

2. The tent as described in claim 1 where panel means comprises a hook attachment means.

3. The tent as described in claim 2 where said periphery panel attachment means comprises a zipper means.

4. The tent as described in claim 1 wherein said panel attachment means is covered on the top and sides by fabric sufficient to prevent water from entering said tent.

5. The tent as described in claim 1 wherein the interior is heated and cooled to a temperature sufficient to keep at least one occupant therein comfortable.

6. The tent as described in claim 1 wherein said phase change material is covered with a plastic translucent film sufficient to permit solar energy to heat said phase change material and cool the tent's interior.

7. The tent as described in claim 1 wherein said phase change material is covered with a plastic film sufficient to permit heat therefrom to heat said interior when solar energy is absent.

8. The tent as described in claim 1 wherein said covering is fabric and said longitudinal walls are sewn to said end walls.

* * * * *